United States Patent [19]

Schaller et al.

[11] Patent Number: 4,760,504

[45] Date of Patent: Jul. 26, 1988

[54] MAGNETICALLY ACTIVATED FLASHLIGHT

[75] Inventors: David R. Schaller, Janesville; El-Sayed Megahed, Madison, both of Wis.; Charles F. Samson, Walpole, Mass.

[73] Assignee: Rayovac Corporation, Madison, Wis.

[21] Appl. No.: 6,118

[22] Filed: Jan. 23, 1987

[51] Int. Cl.[4] ..... F21L 7/00

[52] U.S. Cl. ..... 362/205

[58] Field of Search ..... 362/204, 205, 202, 208

[56] References Cited

U.S. PATENT DOCUMENTS

| | | | |
|---|---|---|---|
| 3,151,263 | 9/1964 | Jolly | 315/129 |
| 3,792,389 | 2/1974 | Murphy | 362/310 |
| 3,898,450 | 8/1975 | Kilby | 362/194 |
| 3,978,330 | 8/1976 | Maurer | 362/158 |
| 4,152,755 | 5/1979 | Trosper et al. | 362/205 |
| 4,458,299 | 7/1984 | Stephens et al. | 362/205 |

*Primary Examiner*—Charles J. Myhre
*Assistant Examiner*—David A. Okonsky
*Attorney, Agent, or Firm*—Kenyon & Kenyon

[57] ABSTRACT

A flashlight is disclosed having a housing for one or more batteries and a socket for a bulb and a reed switch. The reed switch may be disposed either inside or outside the bulb on a socket. A switch activating magnet is slidably disposed on the outside of the housing.

10 Claims, 2 Drawing Sheets

MAGNETICALLY ACTIVATED FLASHLIGHT

BACKGROUND OF THE INVENTION a. Field of Invention

This invention pertains to a magnetically activated flashlight, and more particularly to a flashlight which is selectively activated by opening or closing a reed switch.

b. Description of the Prior Art

Typically flashlights, and more particularly handheld flashlights, include a generally cylindrical housing which contain one or more energy storage devices such as batteries. The cylindrical housing is terminated at one end by a transparent lens behind which there is provided an incandescent light bulb. Frequently the light bulb is surrounded by or otherwise provided with a reflector which collects light generated by the bulb and projects it outwardly through the lens. The shape of the reflector and the relative position of the reflector and bulb determines the geometric configuration of the light beam emerging from the flashlight. The beam may further be shaped optically by the lens.

One common problem for flashlights have been the switching means used for the selective activation and deactivation of the bulb. Most flashlights are provided with a strictly mechanical switch which consists of a pair of flexible blades disposed in parallel and separated by a preset distance. These blades are typically mounted inside the housing, between the housing wall and the batteries, about midway along the length of the housing. A sliding member is mounted on the outside of the housing and is mechanically interlocked with at least one of the blades. The member is slidably mounted on the housing and is arranged so that its movement along the housing selectively forces one of the blades to contact the other blade thereby establishing electrical contact therewith. This type of arrangement has not been reliable for a number of reasons. First, after repeated use, metal fatigue could cause the blades to be distorted easily so that they are either in constant contact or constant separation, independently of the action of the sliding member. Second, oxidation of the blades caused either by ambient atmosphere, or, more frequently, by gases vented from the batteries prevents the formation of a proper, that is, a low ohmic electrical contact between the blades even if the blades are in mechanical contact. A high ohmic contact between the blades results in a low level or even no light from the bulb. Third, because of the mechanical interconnection between the blades and sliding member, it is very difficult and expensive to make the flashlight waterproof. Fourth, because the blades have to fit between the inner housing wall and the batteries, the housing itself must be oversized. Thus, a larger, and more expensive housing is required. A fifth disadvantage of the above described arrangement is that arcing is produced between the blades which reduces the life of the light bulb, and causes pitting in the blades further degrading them.

There have been some attempts at solving some of these problems, for example by replacing the two blades requiring a physical force for electrical contact by a reed switch which uses a magnetic field for the same purpose. One such attempt is found in U.S. Pat. No. 3,792,389 to Murphy. However, in Murphy, the reed switch is made in a cavity formed in the housing thus sacrificing the housing integrity. In U.S. Pat. No. 4,152,755 to Trosper et al. a reed switch is provided inside the housing. However, in this arrangement a special axial space is required between the battery and the bulb to make room for the switch, thus requiring a longer and more expensive housing.

Independently of flashlights, in U.S. Pat. No. 3,151,263, to Jolly, a combination lamp and indicator is described which indicator is resettable by an external magnet.

SUMMARY OF THE INVENTION

In view of the above-mentioned disadvantages in the prior art, an objective of the present invention is to provide a flashlight with a reliable switching means, and which can be housed in a relatively small and space-saving enclosure.

Another objective is to provide a flashlight which can be made air tight and waterproof by providing a switching means which does not require any mechanical interlocks with external members.

Other objectives and advantages of the invention shall become apparent from the following description. In accordance with this invention, a flashlight comprises an enclosure housing one or more energy storage means such as batteries, and a light generating means coupled to the energy storage means by a magnetically activated switching means such as a reed switch. Advantageously, the switching means is integrally incorporated into the light generating means to save space, reduce costs and assure that the housing is water-and air-tight. A switching member which includes a permanent magnet is movably secured on the outside of the enclosure. The magnet generates the field for activating the switching means.

DETAILED DESCRIPTION OF THE INVENTION

Figure 2:
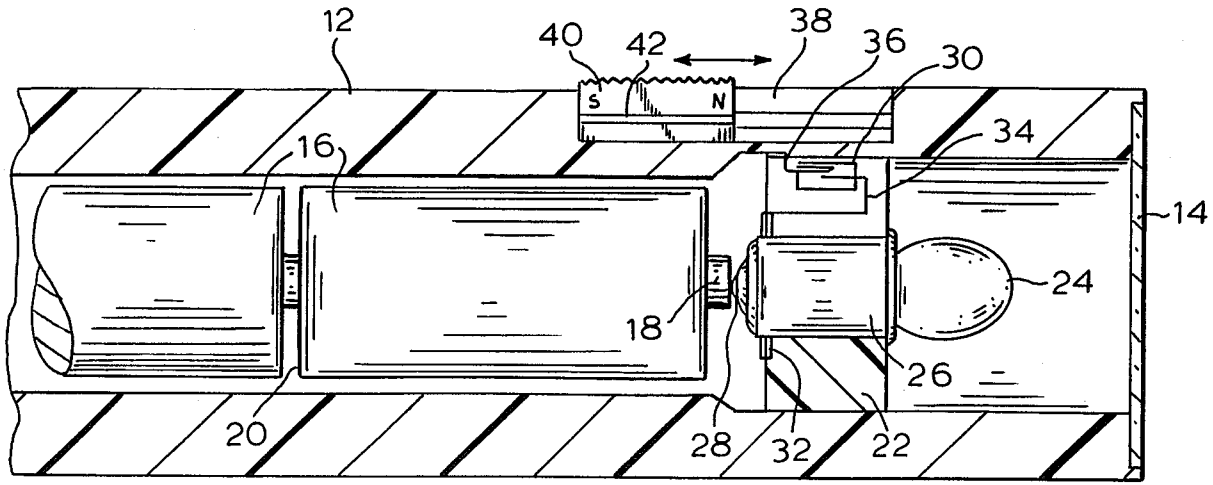
FIG. 2 shows a sectional view of the flashlight of FIG. 1 taken along lines 2—2.
Figure 1:
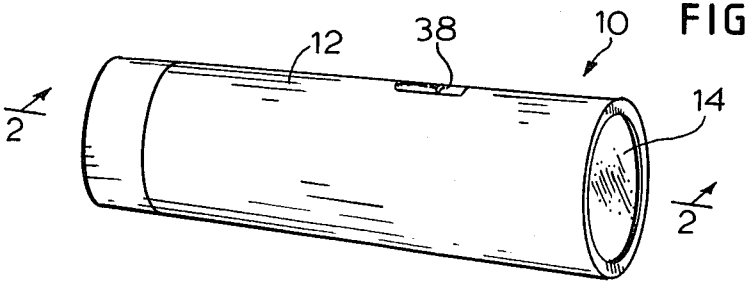
FIG. 1 shows a perspective view of a flashlight constructed in accordance with this invention.

Referring now to the figures, and more particularly to FIGS. 1 and 2, a flashlight 10 constructed in accordance with this invention, has a generally cylindrical enclosure 12 terminating at one end with a lens 14 through which a light beam may be projected. Within the enclosure there are one or more batteries 16. Each battery has a positive terminal 18 and a negative terminal 20. Also within the enclosure there is provided a bulb socket 22. The socket 22 is provided for holding light generating bulb 24. Bulb 24 may have a bayonette type metallic base 26 as shown in FIG. 2, or it may have a flange, bipin, screw, or other type base (not shown). The bulb also has contact pin 28 in electrical and mechanical contact with battery terminal 18.

The socket 22 also holds a reed switch 30. The reed switch is disposed radially outwardly of the bulb base 26 as shown so that no axial space is required within the housing. The socket includes a metallic ring 32 in electrical contact with the bulb base 26. A wire conductor 34 couples one terminal of the reed switch 30 to the socket ring 32. A second wire conductor 36 connects a second terminal of the reed switch to a negative terminal 20 of a battery 16.

On an outer wall of the enclosure, there is a depression 38 which captures a switching element 40. The switching element is axially slidable in the depression 38 as indicated by the bi-directional arrow in FIG. 2. Switching element 40 includes a permanent magnet 42. The switching element 40 and reed switch 30 are arranged so that in an axially forward position of the switch, the reed switch 30 is closed thereby allowing current to flow from the batteries 16 to the bulb 24. When switch 40 is in an axially rearward position, the switch 30 is open and no current flow through the bulb. Advantageously the socket 22 and reed switch 30 are made integrally as a single unit. Thus the whole flashlight 10 can be made from a small number of pieces which may be easily assembled by semi-skilled personnel.

Figure 4:
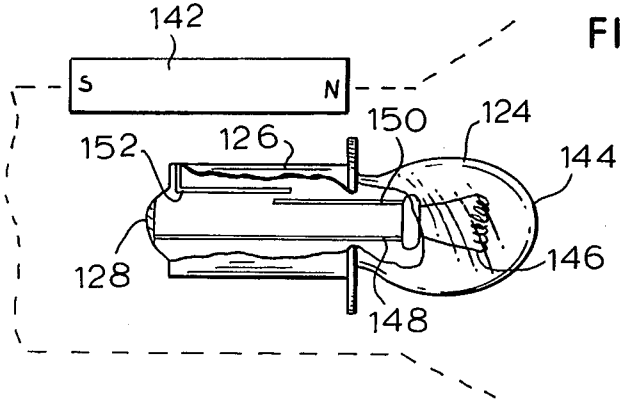
FIG. 4 shows an arrangement of the bulb for the embodiment of FIG. 3.
Figure 3:
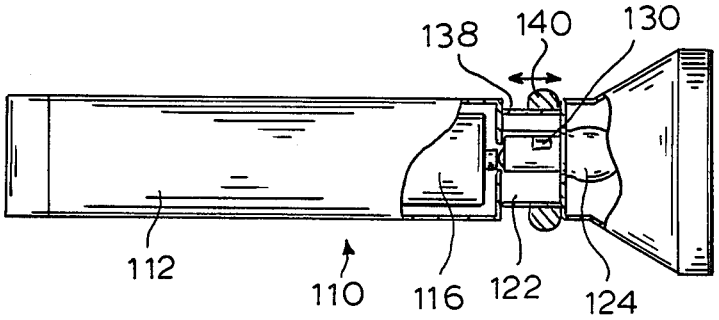
FIG. 3 shows a side, partial sectional view of an alternate embodiment of the invention.
Figure 5:
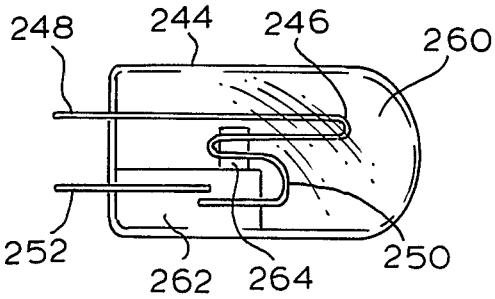
FIG. 5 shows another arrangement of the bulb for the embodiment of FIG. 3.

An alternate embodiment of the invention is shown in FIGS. 3–5. In this embodiment, flashlight 110 has a housing 112 with batteries 116 and a bulb socket 122 in an arrangement similar to FIGS. 1 and 2. However, in this embodiment, the reed switch is built into the bulb 124. The reed switch is activated by a switching element 140 disposed in depression 138. The depression 138 may be annular to house a ring shaped switching element 140. Thus, the switching element may include a toroidal magnet which generates a stronger magnetic field. As shown in FIG. 4, bulb 124 has an envelope 144 which houses an incandescent filament 146. A conductor wire 148 connects an end of filament 146 to contact pin 128. Another conductor wire 150 extends axially through the bulb in parallel with a third conductor wire 152 which is connected to the bulb base 126. Conductor wires 150 and 152 are made of a magnetic material and are relatively flexible to form the reed switch 130.

The bulb 144 is positioned by socket 122 so that the reed switch 130 within the bulb is selectively activated by the switching element 140, and more particularly by magnetic element 142 within the switching element in a manner similar to the operation described above.

In an alternate arrangement shown in FIG. 5, bulb envelope 244 is partitioned into two air tight chambers 260 and 262. Chamber 260 is the main chamber and it holds a first conductor 248, filament 246 and a second conductor 250. In chamber 260 there is provided a support 264 which engages and holds conductor wire 250. Preferably, support 264 has a relatively large surface area and is made of a material having high thermal conductivity to dissipate heat generated by the filament 246. The second chamber 262 holds the end of conductor 250 as well as conductor 252. The two conductors 250 and 252 cooperate to form a reed switch as described above. The reed switch is enclosed in chamber 262 and therefore it is protected from the heat and metallic vapors generated by the filament 246.

In the embodiment shown in FIGS. 3–6 the bulb and the reed switch are advantageously provided in a single hermetically sealed enclosure thus obviating the need for individual enclosures. This feature also reduces the number of parts required for the flashlight as well as the time required to assemble. In addition, both the switch and bulb are replaced simultaneously farther increasing the long term reliability of the flashlight.

Figure 6:
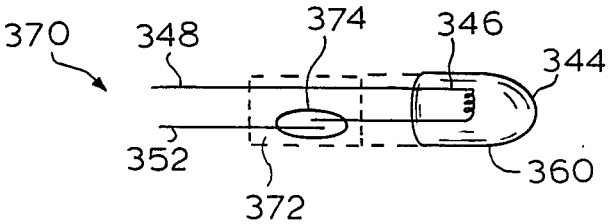
FIG. 6 shows yet another arrangement of the bulb for the bulb for the embodiment of FIG. 3.

In the embodiment of FIG. 6, bulb 344 has an incandescent filament 360 encased in an envelope 360. The envelope is supported by a base 370 which is filled with a potting material 372. Imbedded in the potting material 372 is a reed switch 374, in series with one of the terminals of filament 346. Thus, in this embodiment, the reed switch is thermally isolated from the incandent filament. The two conductors 348 and 352 are connected to the battery.

Figure 7:
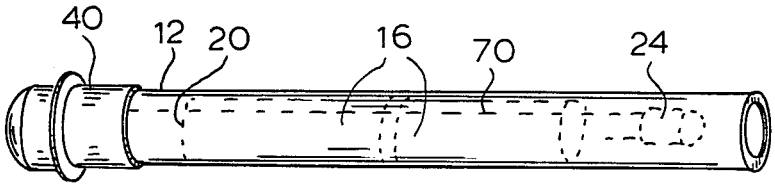
FIG. 7 shows the electrical connections for both embodiments of the invention.

It should be understood that in all the embodiments of the invention a wire conductor 70 runs down the length of the enclosure 12 to connect the socket base to the negative terminal 20 of the last battery 16 to complete the electrical circuit (see FIG. 7). Of course, since switching takes place in the bulb or bulb socket, no switching elements are required on the housing. It should be appreciated that, as seen from the drawings, in all the embodiments of the invention, the bulb and reed switch form a unitary assembly which can be replaced as required independently of the batteries.

Obviously, numerous modifications may be made to the invention without departing from its scope as defined in the appended claims.

What is claimed is:

1. A flashlight comprising:
(a) housing;
(b) battery means disposed within said housing;
(c) socket means disposed within said housing including:
  (i) a bulb for generating light; and
  (ii) switch means for connecting said bulb to said battery means said switch means being enclosed in said bulb and
(d) switch activating means disposed on said housing to selectively activate said switch means.

2. The flashlight of claim 1 wherein said switch means comprises a reed switch activated by a magnetic field and wherein said switch activating means includes a magnet.

3. A flashlight comprising:
(a) a cylindrical housing having a longitudinal axis;
(b) a battery disposed within said housing;
(c) a socket axially spaced from said battery and including:
  (i) a bulb for generating light and having a first bulb conductor connected to said battery and a second bulb conductor; and
  (ii) a reed switch having one terminal connected to said second bulb conductor and a second terminal connected to said battery for energizing said bulb said reed switch being enclosed in said bulb; and
(d) switch activating means disposed on said housing for activating said reed switch, said activating means including a permanent magnet.

4. The flashlight of claim 3 wherein said battery and said socket are disposed along said longitudinal axis and said reed switch is disposed within said socket radially with respect to said bulb.

5. The flashlight of claim 3 wherein said bulb has an incandescent filament and an envelope encasing said filament and said reed switch.

6. The flashlight of claim 5 wherein said bulb is replaceable.

7. The flashlight of claim 5 wherein said envelope is partitioned into a first chamber encasing said filament and a second chamber encasing said reed switch.

8. The flashlight of claim 3 wherein said bulb includes a base for housing said reed switch.

9. The flashlight of claim 3 wherein said socket is replaceable.

10. A flashlight comprising:

(a) a cylindrical housing having a longitudinal axis;

(b) a battery disposed within said housing;

(c) a socket axially spaced from said battery and including:

(i) a bulb for generating light and having a first bulb conductor connect to said battery and a second bulb connector; and (ii) a reed switch having one terminal connected to said second bulb conductor and a second terminal connected to said battery for energizing said bulb; and (d) switch activating means disposed on said housing for activating said reed switch by movement along said longitudinal axis, said activating means including a permanent magnet, said magnet has a toroidal shape and and disposed concentrically around said housing.

* * * * *

UNITED STATES PATENT AND TRADEMARK OFFICE

CERTIFICATE OF CORRECTION

PATENT NO. : 4,760,504

DATED : July 26, 1988

INVENTOR(S) : David R. Schaller, El-Sayed Megahed & Charles F. Samson

It is certified that error appears in the above-identified patent and that said Letters Patent is hereby corrected as shown below:

Col. 2, lines 47-48, delete "for the bulb".

Col. 4, line 37, after "bulb" insert --;--.

Col. 6, line 2, change "connect" to --connected--.

Col. 6, line 11, change "has" to --having--.

Col. 6, line 12, change "and" (second instance) to --being--.

Signed and Sealed this

Twenty-seventh Day of December, 1988

*Attest:*

DONALD J. QUIGG

*Attesting Officer*

*Commissioner of Patents and Trademarks*